US007592554B2

(12) United States Patent
Onodera

(10) Patent No.: US 7,592,554 B2
(45) Date of Patent: Sep. 22, 2009

(54) SWITCH DEVICE

(75) Inventor: Hideji Onodera, Tokyo (JP)

(73) Assignee: Niles Co., Ltd., Tokyo (JP)

( * ) Notice: Subject to any disclaimer, the term of this patent is extended or adjusted under 35 U.S.C. 154(b) by 0 days.

(21) Appl. No.: 12/314,112

(22) Filed: Dec. 4, 2008

(65) Prior Publication Data

US 2009/0166166 A1 Jul. 2, 2009

(30) Foreign Application Priority Data

Dec. 27, 2007 (JP) ..... 2007-337668

(51) Int. Cl.
*H01H 19/00* (2006.01)
*H01H 21/00* (2006.01)

(52) U.S. Cl. ..... 200/6 A; 200/5 R; 200/4

(58) Field of Classification Search ..... 200/6 A
See application file for complete search history.

(56) References Cited

U.S. PATENT DOCUMENTS 7,214,894 B1 * 5/2007 Kakuno et al. ..... 200/6 A
7,227,090 B2 * 6/2007 Kakuno et al. ..... 200/6 A
2002/0003081 A1 * 1/2002 Kawase ..... 200/4
2009/0050465 A1 * 2/2009 Asada ..... 200/6 A

FOREIGN PATENT DOCUMENTS

JP 10-302578 11/1998

* cited by examiner

*Primary Examiner*—Elvin G Enad
*Assistant Examiner*—Lheiren Mae A Anglo
(74) *Attorney, Agent, or Firm*—Rader, Fishman & Grauer PLLC; Christopher M. Tobin

(57) ABSTRACT

A spherical portion of a shaft is provided with engagement projection portions at two locations to be arranged by intervals of 90° in the rotational circumferential direction and there is provided a guide portion including limiting faces for being engaged to the engagement projection portions to lock a swing motion of the shaft and release recessed portions for releasing the engagement of the engagement projection portions at a switch operational position where the operational knob is rotated to allow an operation of the inclination motion by the operational knob in a plane direction due to the swing of the shaft. This construction thus prevents the operation of the inclination motion by the operational knob when the operational knob is at a neutral position.

2 Claims, 4 Drawing Sheets

SWITCH DEVICE

CROSS-REFERENCE TO RELATED APPLICATION

This application claims priority under 35 USC 119 from Japanese Patent Application No. 2007-337668, the disclosure of which is incorporated by reference herein.

BACKGROUND OF THE INVENTION

1. Field of the Invention

The present invention relates to a switch device for operating an orientation direction of each of right and left mirrors for an automobile or the like.

2. Description of Related Art

Japanese Patent Laid-Open No. 10-302578 discloses a conventional switch device as an example.

This switch device is a mirror control switch which changes and operates an orientation direction of each of right and left mirrors for an automobile. In this mirror control switch, an operational knob is operated to rotate around the axis from a neutral position to any direction to set a switch operational position in either one of the right and left directions, thus selecting either one of the right and left mirrors. The operational knob is operated to be inclined toward a plane direction along a rotational radius at the switch operational position, so that the orientation direction of the selected right or left mirror can be changed.

However, in the conventional mirror control switch, the operational knob can perform an operation of an inclination motion even at the neutral position thereof, and therefore, it has the problem that it is difficult to distinguish the neutral position over the switch operational position.

In consequence, since the orientation direction of the mirror is not changed regardless of the operation for the inclination motion by the operational knob performed at the neutral position, a user possibly has a strange feeling at the time of the operating.

Further, the operation of the inclination motion by the operational knob at the neutral position is wastefully performed, possibly damaging durability of the switch device including the switch knob.

That is, the conventional switch device has the problem that the operational knob can perform an operation of an inclination motion even at the time the operational knob is at a neutral position.

In view of the above, there exists a need for a switch device which overcomes the above mentioned problems in the conventional art. The present invention addresses this need in the conventional art as well as other needs, which will become apparent to those skilled in the art from this disclosure.

SUMMARY OF THE INVENTION

The present invention is made in view of the foregoing problem and the present invention has an object of providing a switch device which can easily distinguish a neutral position of an operational knob over a switch operational position thereof.

For preventing an operational knob from performing an operation of an inclination motion at a neutral position thereof, a switch device according to an aspect of the present invention comprises:

an operational knob;

a switch case attached to the operational knob;

a shaft having an end portion provided with the operational knob and an intermediate portion accommodated and supported in the switch case so as to be rotatable around an axis of the shaft and swing in an rotational radial direction of the shaft, the shaft enabling an operation of an inclination motion at a switch operational position where the operational knob is rotated from a neutral position;

first and second stationary contact points located in the switch case;

a first movable board supported in the switch case in such a manner as to be rotatable around an axis to the switch case and provided with a first movable element for switching a rotational direction contact position to the first stationary contact point in accordance with the rotation of the shaft; and a second movable board supported in the switch case in such a manner as to be movable in the plane direction and provided with a second movable element for switching a plane direction contact position to the second stationary contact point in accordance with the swing motion of the shaft, wherein:

one of the switch case and the shaft is provided with engagement projection portions at a plurality of locations in a rotational circumferential direction; and the other of the switch case and the shaft is provided with a guide portion including a limiting face for being engaged to the engagement projection portion at the neutral position of the operational knob to lock the swing motion of the shaft and a release recessed portion for releasing the engagement of the engagement projection portion at the switch operational position where the operational knob is rotated to allow the operation of the inclination motion by the operational knob in the plane direction by the swing motion of the shaft.

ADVANTAGE OF THE ASPECT OF THE INVENTION

According to the switch device as described above, one of the switch case and the shaft is provided with engagement projection portions at a plurality of locations in a rotational circumferential direction and the other of the switch case and the shaft is provided with a guide portion including a limiting face for being engaged to the engagement projection portion a the neutral position of the operational knob to lock the swing motion of the shaft and a release recessed portion for releasing the engagement of the engagement projection portion at the switch operational position where the operational knob is rotated to allow the operation of the inclination motion by the operational knob in the plane direction by the swing motion of the shaft.

Therefore, the engagement projection portion is engaged to the limiting face of the guide at the neutral position of the operational knob to lock the swing motion of the shaft, and at the switch operational position where the operational knob is rotated, the engagement of the engagement projection portion is released by the release recessed portion of the guide portion. As a result, the operation of the inclination motion by the operational knob can be allowed.

Therefore, it is easy to distinguish the neutral position of the operational knob over the switch operational position thereof.

The switch operation by the inclination motion of the operational knob can not be performed at the neutral position, so that a secure switch operation without a strange feeling caused by the operational knob at the switch operational position can be performed.

Further, the operation of the inclination motion by the operational knob at the neutral position is not performed wastefully, improving durability of the switch device.

BRIEF DESCRIPTION OF THE DRAWINGS

Other objects, features, and advantages of the present invention will become more apparent from the following detailed description made with reference to the accompanying drawings, in which like parts are designated by like reference numbers and in which.

DETAILED DESCRIPTION OF THE EXAMPLE EMBODIMENT

Hereinafter, a switch device according to an embodiment of the present invention will be explained with reference to the accompanying drawings.

Embodiment

Entire Structure of a Switch Device

Figure 1:
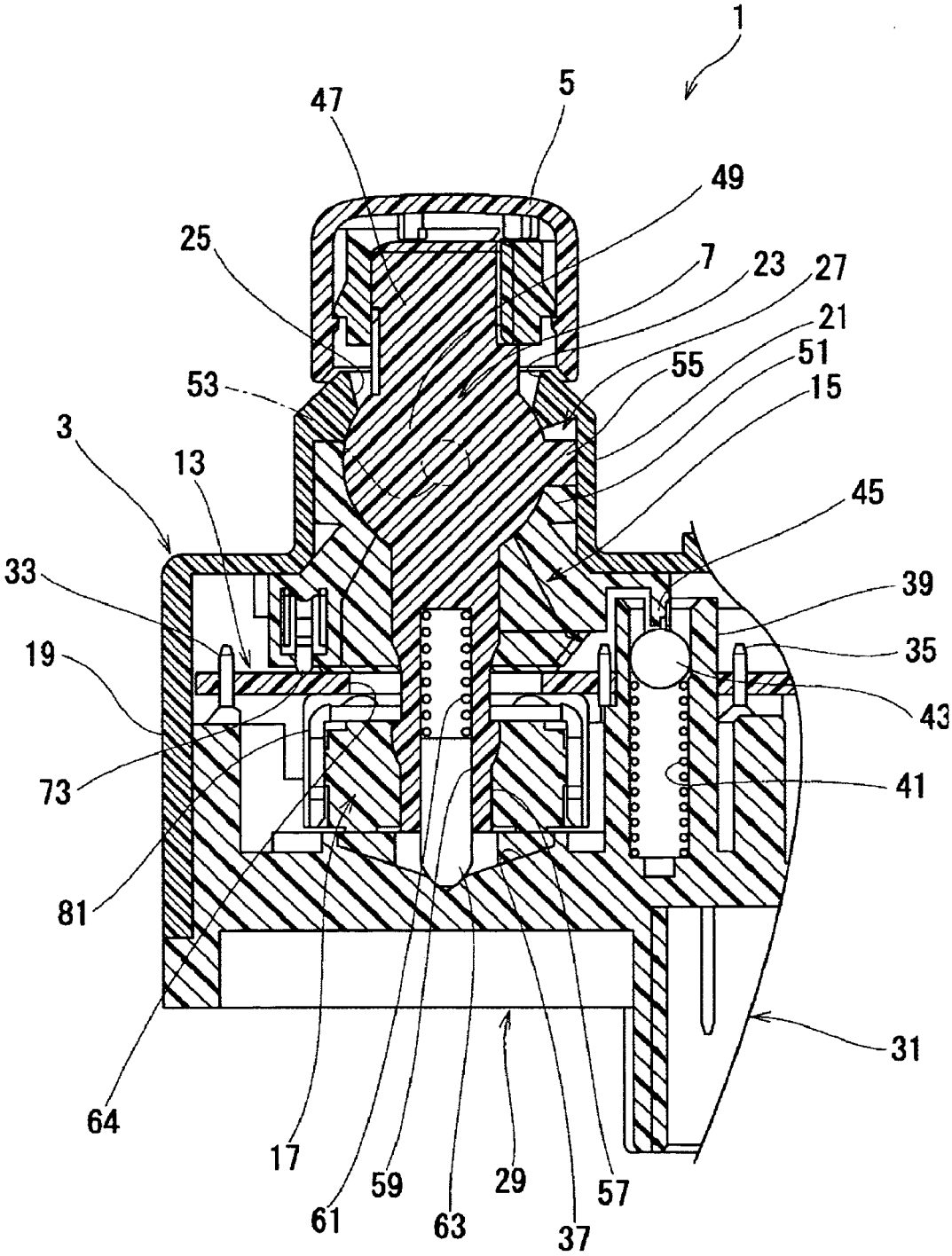
FIG. 1 is a cross section showing a part of a switch device according to an embodiment of the present invention.
Figure 2:
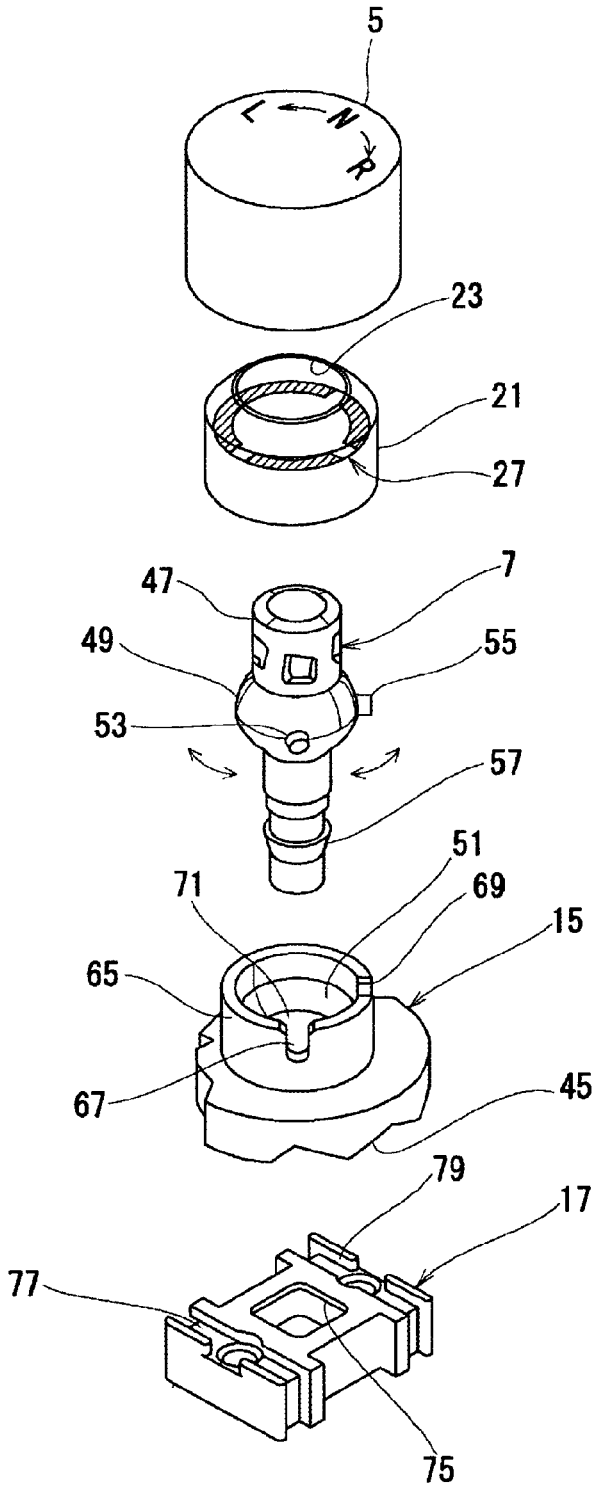
FIG. 2 is an exploded perspective view showing the switch device according to the embodiment of the present invention.
Figure 3:
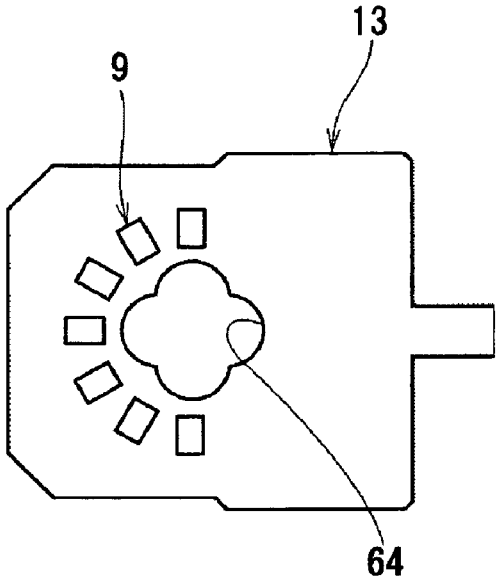
FIG. 3 is a plan view showing a first stationary contact point side of a base plate according to the embodiment of the present invention.
Figure 4:
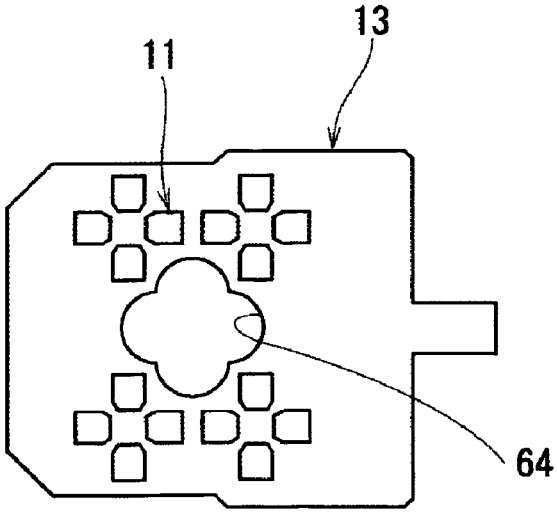
FIG. 4 is a bottom view showing a second stationary contact point side of the base plate according to the embodiment of the present invention.

FIG. 1 is a cross section showing a part of a switch device according to an embodiment of the present invention. FIG. 2 is an exploded perspective view showing the switch device. FIG. 3 is a plan view showing a first stationary contact point side of a base plate. FIG. 4 is a bottom view showing a second stationary contact point side of the base plate.

The switch device of the present embodiment is applied as a mirror control switch for operating right and left mirrors for an automobile.

As shown in FIGS. 1 to 4, a mirror control switch 1 is provided with a switch case 3, a shaft 7 equipped with an operational knob 5, a base plate 13 equipped with a first stationary contact point 9 at a front side surface and a second stationary contact point 11 at a back side surface, a first movable board 15 arranged on an upper side of the base plate 13, and a second movable board 17 arranged on a lower side of the base plate 13.

The switch case 3 is provided with an axis support tubular portion 21 at an upper portion of a case body 19. The axis support tubular portion 21 is provided with an opening 23 at an upper portion and a case-side spherical support portion 25 at an inside portion. A guide portion 27 is formed at a lower side of the case-side spherical support portion 25. A detail of the guide portion 27 will be described later.

A pole board 29 is fixed at a lower portion of the switch case 3. A connector portion 31 for external connection is located at the pole board 29. Terminals 33 and 35 connected electrically to the connector portion 31 are provided at the pole board 29. A clicking recessed portion 37 and a clicking support tubular portion 39 are formed in the pole board 29. A clicking spring 41 and a clicking ball 43 are accommodated in the clicking support tubular portion 39 and the clicking ball 43 is flexibly in contact with a clicking projection portion 45 of the first movable board 15.

The operational knob 5 is attached to an end portion 47 of the shaft 7. The end portion 47 protrudes from the opening 23 of the axis support tubular portion 21. The shaft 7 is provided with a spherical portion 49 in an intermediate portion in the axis support tubular portion 21. The shaft 7 is constructed so that the spherical portion 49 is spherically supported between the case-side spherical support portion 25 and the a movable board-side spherical support portion 51 of the first movable board 15 and is supported to the side of the switch case 3 in such a manner as to be rotatable around an axis and swing in a rotational radial direction.

The spherical support of the shaft 7 causes the operational knob 5 to rotate from a neutral position (N) to a switch operational position (L or R), enabling an operation of an inclination motion by the operational knob 5 in a plane direction along a rotational radius of the operational knob 5. The operation of the inclination motion in the plane direction means that the operational knob 5 is operated to be inclined within a range of 360°.

The spherical portion 49 of the shaft 7 is provided with engagement projection portions 53 and 55 in such a manner as to protrude therefrom. The engagement projection portions 53 and 55 will be in detail described later together with the guide portion 27.

A clicking support bore 59 is formed in a lower portion 57 of the shaft 7, and a clicking spring 61 and a clicking body 63 are accommodated in the clicking support bore 59. The clicking body 63 is flexibly in contact with the clicking recessed portion 37 of the pole board 29.

The base plate 13 provided with the first and second stationary contact points 9 and 11 is provided with a through opening 64 at a central portion through which the shaft 7 penetrates. The base plate 13 is fixed inside the switch case 3 and is connected to terminals 33 and 35.

The first movable board 15 is arranged on an upper surface (side of the first stationary contact point 9) of the base plate 13. The first movable board 15 is formed in a hollow, rotational element shape and has an upper portion where an engagement tubular portion 65 is formed and a lower portion where the clicking projection portion 45 is formed. Engagement recessed portions 67 and 69 are formed in the engagement tubular portion 65 to be arranged at intervals of 90° in the circumferential direction. The engagement projection portions 53 and 55 of the shaft 7 are engaged to the engagement recessed portions 67 and 69. The movable board-side spherical support portion 51 is formed in the through bore 71 of the first movable board 15. The first movable board 15 is provided with a pair of first movable elements 73 in parallel to each other in the circumferential direction at a lower surface portion in an opposite side to the clicking projection portion 45 (however, only one thereof is shown in the figure). Each of the first movable elements 73 is urged by a spring to be in contact with the stationary contact point 9.

The lower portion 57 of the shaft 7 is located to penetrate through the through bore 71 of the first movable board 15, and the spherical portion 49 of the shaft 7 is spherically supported between the movable board-side spherical support portion 51 and the case-side spherical support portion 25. The spherical support causes the first movable board 15 to be rotated around an axis to the switch case 3. Therefore, by rotation of the shaft 7 caused by the rotational operation of the operational knob 5, a contact position of the rotational direction of the first movable element 73 to the first stationary contact point 9 is switched through engagement between the engagement projection portions 53 and 55 and the engagement recessed portions 67 and 69.

The second movable board 17 is arranged on the pole board 29 at a lower surface of the base plate 13 (side of the second stationary contact point 11). The second movable board 17 is formed in a rectangular shape and has a shaft engagement hole 75 formed in a rectangular shape at the center. Movable element support portions 77 and 79 are formed at both sides of the shaft engagement hole 75. Second movable elements 81 are supported by the respective movable elements 77 and 79 (however, only one thereof is shown in the figure). Each second movable element 81 is urged by a spring and is in contact with the second stationary contact point 11.

The lower portion 57 of the shaft 7 is engaged to the shaft engagement hole 75 of the second movable board 17 and the second movable board 17 is supported in such a manner as to be movable in a plane direction along a rotational radius of the operational knob 5 to the switch case 3 on the pole board 29. Because of the movable support in the plane direction, when the operational knob 5 is operated to be inclined in a plane direction at the switch operational position, a contact position of the second movable element 81 in a plane direction to the second stationary contact point 11 is switched through engagement between the lower portion 57 and the shaft engagement hole 75 to the swing motion of the shaft 7.

[Engagement Projection Portion and Guide Portion]

Figure 5:
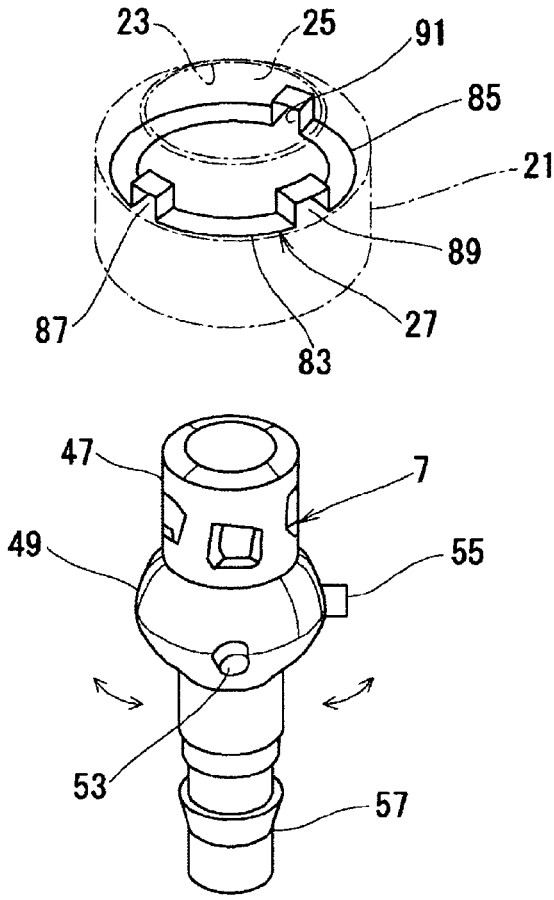
FIG. 5 is a perspective view showing a relation between engagement projection portions and a guide portion according to the embodiment of the present invention.
Figure 6:
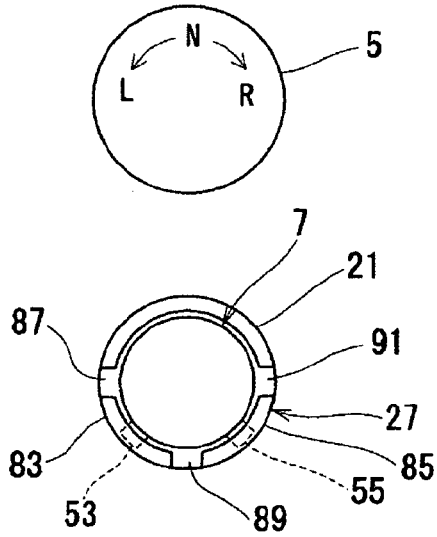
FIG. 6 is an explanatory diagram showing a relation between an operational knob, and the engagement projection portions and the guide portion according to the embodiment of the present invention.

As shown in FIGS. 5 and 6, the engagement projection portions 53 and 55 are provided on a circumferential surface of the spherical portion 49 in the side of the shaft 7 at two locations to be arranged by intervals of 90° in a rotational circumferential direction.

The guide portion 27 comprises limiting faces 83 and 85 and release recessed portions 87, 89 and 91, which are, as described above, provided in the axis support tubular portion 21 in the side of the switch case 3.

The limiting faces 83 and 85 are provided at two locations between the release recessed portions 87, 89 and 91 to be arranged by intervals of 90° in a rotational circumferential direction. The limiting faces 83 and 85 are engaged to the engagement projection portions 53 and 55 at a neutral position of the operational knob 5 to lock the swing motion of the shaft 7.

The release recessed portions 87, 89 and 91 are formed between the limiting faces 83 and 85, and at end portions of the limiting faces 83 and 85, and provided at three locations to be arranged by intervals of 90° in a rotational circumferential direction from each other. The release recessed portions 87, 89 and 91 release the engagement of the engagement projection portions 53 and 55 at the switch operational position where the operational knob 5 is rotated, allowing the operation of the inclination motion by the operational knob 5 in the plane direction by the swing motion of the shaft 7.

"N" formed on an upper surface of the operational knob 5 displays a neutral position of the operational knob 5, and "L" and "R" on the upper surface of the operational knob 5 display switch operational positions of the right and left mirrors at both sides in a rotational direction of the operational knob 5 to the neutral position.

[Knob Operation]

At the neutral position where the operational knob 5 is not operated to rotate to any of the right and the left, "N" of the operational knob 5 is, for example, at a central position and the engagement projection portions 53 and 55 are, as shown in FIG. 6, engaged to the intermediate portions of the limiting faces 83 and 85 from the lower face side Therefore, even if the operational knob 5 is operated to be inclined in the plane direction, the engagement projection portions 53 and 55 are engaged to the limiting faces 83 and 85 to lock the operational knob 5, which can not perform the operation of the inclination motion.

When the operational knob 5 is rotated from an N position to a R side, the shaft 7 rotates around the axis with the rotation of the operational knob 5, the engagement projection portions 53 and 55 face the release recessed portions 87 and 89 at the switch operational position of R. This facing releases the lock of the engagement projection portions 53 and 55 by the limiting faces 83 and 85.

By the axis rotation of the shaft 7 due to rotation to the R side of the operational knob 5, as described above, a contact position in a rotational direction of the first movable element 73 to the first stationary contact point 9 is switched to select the right-side mirror for an automobile.

As a result of the lock release at the release recessed portions 87 and 89, the engagement projection portions 53 and 55 operate in the release recessed portions 87 and 89 at the time of the swing motion of the shaft 7 by an operation of the operational knob 5, allowing the operation of the inclination motion of the operational knob 5 in the plane direction.

The operation of the inclination motion of the operational knob 5 switches the contact position in the plane direction of the second movable element 81 to the second stationary contact point 11, making it possible to change the orientation direction of the selected right-side mirror.

When the operational knob 5 is rotated from an N position to an L side, the shaft 7 rotates around the axis with the rotation of the operational knob 5, the engagement projection portions 53 and 55 face the release recessed portions 89 and 91 at the switch operational position of L. This facing releases the lock of the engagement projection portions 53 and 55 by the limiting faces 83 and 85.

By the axis rotation of the shaft 7 due to rotation to the L side of the operational knob 5, as described above, a contact position in a rotational direction of the first movable element 73 to the first stationary contact point 9 is switched to select the left-side mirror for an automobile.

As a result of the lock release at the release recessed portions 89 and 91, the engagement projection portions 53 and 55 operate in the release recessed portions 89 and 91 at the time of the swing motion of the shaft 7 by an operation of the operational knob 5, allowing the operation of the inclination motion of the operational knob 5 in the plane direction.

The operation of the inclination motion of the operational knob 5 switches the contact position in the plane direction of the second movable element 81 to the second stationary contact point 11, making it possible to change the orientation direction of the selected left-side mirror.

ADVANTAGE OF THE EMBODIMENT

A switch device 1 according to the embodiment of the present invention comprises an operational knob 5, a switch case 3 attached to the operational knob 5, a shaft 7 having an end portion provided with the operational knob 5 and a spherical portion 49 of an intermediate portion accommodated and supported in the switch case 3 so as to be rotatable around an axis of the shaft 7 and swing in an rotational radial direction, the shaft 7 enabling an operation of an inclination motion by the operational knob 5 toward a plane direction along a rotational radius of the operational knob 5 at a switch operational position R (or L) where the operational knob 5 is rotated from a neutral position N, first and second stationary contact points 9 and 11 located in the switch case 3, a first movable board 15 supported in the switch case 3 in such a manner as to be rotatable around an axis to the switch case 3 and provided with a first movable element 73 for switching a rotational direction contact position to the first stationary contact point 9 in accordance with the rotation of the shaft 7, and a second movable board 17 supported in the switch case 3 in such a manner as to be movable in the plane direction and provided with a second movable element 81 for switching a plane direction contact position to the second stationary contact point 11 in accordance with the swing motion of the shaft 7, wherein the spherical portion 49 of the side of the shaft 7 is provided with engagement projection portions 53 and 55 at two locations to be arranged by intervals of 90° in a rotational circumferential direction, and the axis support tubular portion 21 of the side of the switch case 3 is provided with a guide portion 27 including limiting faces 83 and 85 for being engaged to the engagement projection portions 53 and 55 at the neutral position N of the operational knob 5 to lock the swing motion of the shaft 7 and release recessed portions 87, 89 and 91 for releasing the engagement of the engagement projection portions 53 and 55 at the switch operational position R (or L) where the operational knob 5 is rotated, to allow the operation of the inclination motion by the operational knob 5 in the plane direction by the swing motion of the shaft 7.

According to the switch device 1 as described above, the engagement projection portions 53 and 55 are engaged to the limiting face 83 and 85 of the guide portion 27 at the neutral position N of the operational knob 5 to lock the swing motion of the shaft 7, and at the switch operational position R (or L) where the operational knob 5 is operated to be rotated, the engagement of the engagement projection portion 53 and 55 are released by the release recessed portions 87 and 89 (or 89 and 91) of the guide portion 27. As a result, the operation of the inclination motion by the operational knob 5 in the plane direction by the swing motion of the shaft 7 can be allowed.

Therefore, it is easy to distinguish the neutral position N of the operation knob 5 over the switch operational position R (or L) thereof.

The switch operation of the inclination motion by the operational knob 5 can not be performed at the neutral position N, so that a secure switch operation without a strange feeling caused by the operational knob 5 can be performed at the switch operational position R (or L).

Further, the operation of the inclination motion of the operational knob 5 at the neutral position N is not performed wastefully, improving durability of the switch device 1.

The switch operational positions R and L are provided at both sides of the neutral position N in the rotational operation direction and selection of one of the right and left mirrors for an automobile is made by switching the contact position in the rotational direction of the first movable element 15 to the first stationary contact point 9. The operation of the inclination motion by the operational knob 5 switches the contact position in the plane direction of the second movable element 81 to the second stationary contact point 11, making it possible to change the orientation direction of the selected mirror.

Therefore, the switch device can be constructed as the mirror control switch 1 to lock the operation of the inclination motion by the operational knob 5 at the neutral position N.

[Others]

The engagement projection portions 53 and 55 may be located at the side of the switch case 3 and the guide portion 27 may be located at the side of the shaft 7.

In the switch device, it may be required only that the operation of the inclination by the operational knob is locked at the neutral position and the lock is released at the switch operational position to perform the operation of the inclination motion by the operational knob, and therefore, the switch operational position of the operational knob may be arranged only at a location where the operational knob is rotated from the neutral position toward one side.

The switch device may be applied to a switched other than the mirror control switch.

While only the selected embodiment has been chosen to illustrate the present invention, it will be apparent to those skilled in the art from this disclosure that various changes and modifications can be made therein without departing from the scope of the invention as defined in the appended claims. Furthermore, the foregoing description of the embodiment according to the present invention is provided for illustration only, and not for the purpose of limiting the invention as defined by the appended claims and their equivalents.

DESCRIPTION OF THE CODES

1: MIRROR CONTROL SWITCH (SWITCH DEVICE)
3: SWITCH CASE
5: OPERATIONAL KNOB
7: SHAFT
9: FIRST STATIONARY CONTACT POINT
11: SECOND STATIONARY CONTACT POINT
15: FIRST MOVABLE BOARD
17: SECOND MOVABLE BOARD
27: GUIDE PORTION
53, 55: ENGAGEMENT PROJECTION PORTION
73: FIRST MOVABLE ELEMENT
81: SECOND MOVABLE ELEMENT
83, 85: LIMITING FACE
87, 89, 91: RELEASE RECESSED PORTION

What is claimed is:

1. A switch device comprising:

an operational knob;

a switch case attached to the operational knob;

a shaft having an end portion provided with the operational knob and an intermediate portion accommodated and supported in the switch case so as to be rotatable around an axis of the shaft and swing in a rotational radial direction, the shaft enabling an operation of an inclination motion at a switch operational position where the operational knob is rotated from a neutral position;

first and second stationary contact points located in the switch case;

a first movable board supported in the switch case in such a manner as to be rotatable around an axis to the switch case and provided with a first movable element for switching a rotational direction contact position to the first stationary contact point in accordance with the rotation of the shaft; and a second movable board supported in the switch case in such a manner as to be movable in the plane direction and provided with a second movable element for switching a plane direction contact position to the second stationary contact point in accordance with the swing motion of the shaft, wherein one of the switch case and the shaft is provided with engagement projection portions at a plurality of locations in a rotational circumferential direction; and the other of the switch case and the shaft is provided with a guide portion including a limiting face for being engaged to the engagement projection portion at the neutral position of the operational knob to lock the swing motion of the shaft and a release recessed portion for releasing the engagement of the engagement projection portion at the switch operational position where the operational knob is rotated to allow the operation of the inclination motion by the operational knob in the plane direction by the swing motion of the shaft.

2. A switch device according to claim 1, wherein:

the switch operational position is provided at both sides of the neutral position in the rotational operation direction;

selection of one of right and left mirrors for an automobile is made by switching the contact position in the rotational direction of the first movable element to the first stationary contact point; and the orientation direction of the selected mirror is changed by switching the contact position in the plane direction of the second movable element to the second stationary contact point.

* * * * *